US005475721A

United States Patent [19]

Baatz et al.

[11] Patent Number: 5,475,721

[45] **Date of Patent: * Dec. 12, 1995**

[54] RADIATION-SHIELDING TRANSPORT AND STORAGE CONTAINER

[75] Inventors: Henning Baatz; Dieter Rittscher; Jürgen Wriegt, all of Essen, Germany

[73] Assignee: GNS Gesellschaft fur Nuklear-Service mbH, Essen, Germany

[ * ] Notice: The portion of the term of this patent subsequent to Jul. 9, 2002, has been disclaimed.

[21] Appl. No.: 607,197

[22] Filed: May 4, 1984

Related U.S. Application Data

[63] Continuation-in-part of Ser. No. 243,627, Mar. 13, 1981, Pat. No. 4,528,454.

[51] Int. Cl.[6] ..... G21C 19/06

[52] U.S. Cl. ..... 376/272

[58] Field of Search ..... 250/506.1; 376/272

[56] References Cited

U.S. PATENT DOCUMENTS 4,495,139 1/1985 Janberg et al. ..... 376/272

4,528,454 7/1985 Baatz et al. ..... 250/506.1

FOREIGN PATENT DOCUMENTS 3025795 1/1982 Germany ..... 376/272

3222749 12/1983 Germany ..... 376/272

2081169 2/1982 United Kingdom ..... 250/506.1

*Primary Examiner*—Charles T. Jordan

*Attorney, Agent, or Firm*—Herbert Dubno; Andrew Wilford

[57] ABSTRACT

A shielding container for the transport and storage of irradiated nuclear fuel elements has a cast-metal vessel provided with a radiation-shielding cover whose cylindrical flange is bolted to a shoulder of a seat in the mouth of this vessel and has a thickness of two to four times the thickness of a projection of this cover extending into the space of the vessel receiving the radioactive material. A further cover has a projection extending into the seat and a flange overlying and bolted to the vessel wall. The thickness of the latter flange is twice the thickness of the projection of the further cover and both covers define annular control compartments whereby the sealing effectiveness can be monitored.

1 Claim, 2 Drawing Sheets

RADIATION-SHIELDING TRANSPORT AND STORAGE CONTAINER

CROSS REFERENCE TO RELATED APPLICATION

This application is a continuation-in-part of application Ser. No. 243,627 filed 13 Mar. 1981, now U.S. Pat. No. 4,528,454 and which is hereby incorporated in its entirety by reference.

FIELD OF THE INVENTION

Our present invention relates to a transport and storage container for radioactive material and, especially, irradiated nuclear fuel elements.

BACKGROUND OF THE INVENTION

In a number of prior applications and patents mentioned in the above-identified copending application and in the latter, there are described vessels or containers which have been found to be useful in the transport and storage of radioactive material and especially irradiated nuclear fuel elements.

These containers have in common the fact that they comprise a vessel which can be cast from a cast iron, especially spherulitic or nodular cast iron or cast steel, which is open at its upper end and has comparatively thick walls and a bottom, and into which the irradiated fuel elements can be introduced. The mouth of the vessel is sealed by a plug-like cover which has a projecting portion fitting into the mouth and a flange supporting the projecting portion and a shoulder surrounding the mouth.

As described in the aforementioned application, various types of seals may be provided between this cover and the vessel and the plug-type cover, also of cast iron or cast steel, and the thick walls and bottom of the container are all dimensioned so that practically no radiation from the interior reaches the environment.

In the numerous applications and patents referred to in the specifically identified parent application hereof, it has been pointed out that it may be advantageous to provide the outer wall of the vessel with ribs or vanes to promote dissipation of heat to ambient fluids, and that the wall of the vessel can be provided with passages in such orientation and number as to enable them to contain materials with a high neutron-capture cross section or other affinity for the capture of radiation so that practically a complete curtain for such radiation capture is provided within the wall surrounding the nuclear fuel elements.

The wall may also be provided with a passage opening into the space defined within the container and in which the radioactive fuel elements can be disposed for introducing fluids or for sampling. Security can be ensured by providing one or more additional covers above the shielding or plug-type cover which themselves can be sealed to the vessel and which can define monitoring spaces with each next inwardly disposed cover. By monitoring fluids entering these spaces, the failure of a container seal can be ascertained.

These and other arrangements described in the aforementioned applications have contributed to the success of such containers in the handling of radioactive materials.

In application Ser. No. 243,627 U.S. Pat. No. 4,528,454, however, a special organization of the covers has been described in which the shielding cover is seated in a stepped seat of the mouth of the container and O-rings or like sealing members are provided between juxtaposed surfaces of this seat and the plug-type cover. An additional cover was applied to the container and likewise was sealed with respect to the latter by such sealing means.

The shielding cover was formed with a central projection and integral therewith but thereabove, an outwardly extending circumferential flange of cylindrical configuration, this flange being received in a cylindrical portion of the step defining an inwardly extending shoulder at the step upon which the flange rests and to which the flange can be connected by flange bolts traversing the flange and threadedly engaging in bores which open at the shoulder of the stepped mouth of the container.

To this end, bolt bores are provided in the flange for registry with the threaded bores in the container wall. In addition, the plug-type cover can have a multiplicity of cover bores which can communicate with the space defined by the container directly or with bores in the wall of the container which, in turn, communicate with the storage space of the container, these bores serving as control bores or for monitoring, filling or sampling purposes. The control bores open into an annular control compartment between spaced-apart seals. Frequently, complex means must be used to seal these additional bores and, in general, the control and monitor bores provided in the plug-type cover.

While the system described in this latter application has proved to be highly effective for the purposes described, it has now been found to be possible to improve upon it.

OBJECTS OF THE INVENTION

It is, therefore, the principal object of the present invention to provide an improved transport and storage container which advances the principles set forth in application U.S. Pat. No. 4,528,454 and, in the most general terms, provides a better cover assembly for a container of this type.

Another object of this invention is to provide a container utilizing the principles of the application Ser. No. U.S. Pat. No. 4,528,454 but which provides greater mechanical reliability and stability, even against extreme mechanical stresses which might distress the sealing function and which also provides for effective monitoring of the sealing function.

SUMMARY OF THE INVENTION

We have now found that the cover structure of the container can be made far more stable and resistant to mechanical effects such as impact when, instead of using a non-circular flange for the plug-type cover, this flange is cylindrical and has a thickness of at least two and up to four times the thickness of the projecting portion of this cover and is received within a seat which has a height greater than the flange height so that the additional cover can also have a plug configuration and can be provided with a projecting portion which is received snugly in the cylindrical mouth of the container while its flange extends laterally outwardly and circularly to overlie the upper end of the container, both flanges being bolted to the wall of the container via bore holes through the flange and the annular monitoring compartments for checking the circuit of the seal being provided between the respective flanges and the shoulder or the end of this wall proximal to the bolts by which the flanges are secured to the wall.

The improvement of the invention, therefore, utilizes a shielding cover which comprises the central projection previously mentioned and a cylindrical flange extending outwardly of this projection but of a thickness of two to four times the thickness of the projection and preferably about three times this thickness. The annular control compartment of the sliding cover is provided in the direct vicinity of the bolts which pass through the cover flange and secure this flange against a shoulder within the seat in the mouth of the container. It is of considerable importance to the present invention that the additional cover, which is applied outwardly of the main plug type or sliding cover, also has a projection which extends into a seat for the radiation-shielding cover and preferably has a diameter substantially equal to the diameter of the cylindrical flange.

However, this additional cover has a flange which can be about twice the thickness of its projection and which overlies the end of the container surrounding the additional cover projection and which is not recessed in the radiation-shielding cover or the end of the container or vessel.

The container of the present invention has all of the advantages of the container described in application U.S. Pat. No. 4,528,454 and which differs from the container of the present invention in several respects, e.g. in that the flange of the shielding cover is not cylindrical, that the further cover is recessed in the end of the container and in that the thickness of the flange of the shielding cover approximates the thickness of the projection thereof. Other differences will become apparent from the description below.

It has been found that when the container of application Ser. No. U.S. Pat. No. 4,528,454 is subjected to sharp impact, e.g. when it falls on the upper edge of the container, the non-cylindrical configuration of the radiation flange may be stressed-non-uniformly and the recessed cover weakens the upper edge or rim of the container contributing to a distortion of the vessel and a tendency to rupture the seal.

Of course, the lack of a differentiation between a projection on the additional cover and the flange thereof also contributes to the danger of distortion of this cover.

Consequently, the arrangement of the invention is far superior with respect to mechanical stability than this earlier system since the fixed cylindrical flange of the radiation shielding cover practically precludes distortion invited with thinner flanges while the same is true with the further cover. Indeed, the structurally stable flanges and the respective covers are not seriously deformed so that generally the control spaces remain sealed even with the most severe impact. Transverse deformation of the bolts can be prevented and the system is found to be structurally stable even with most severe impacts which readily break the seal in earlier systems. It appears that the main reason for the difference in results on impact tests is that the non-cylindrical flange and its arrangement with respect to the recessed further cover of our earlier system creates a statically indeterminate structure while the structure of the present invention is both statically determinate and highly resistant to the effects which distort the structure in the earlier system.

For example, at least in part by reasonable projection of the additional cover, shear effects are taken up by the projection of the additional cover itself and are not applied to the bolts connecting the latter to the end of the container.

The two covers individually and collectively form a rigid impact-resistant structure with the flanges abutting the end of the container and the aforementioned shoulder so that deformation of the flanges is practically excluded. The control compartments lie in structurally stable and secure regions so that their seals do not tend to break either.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
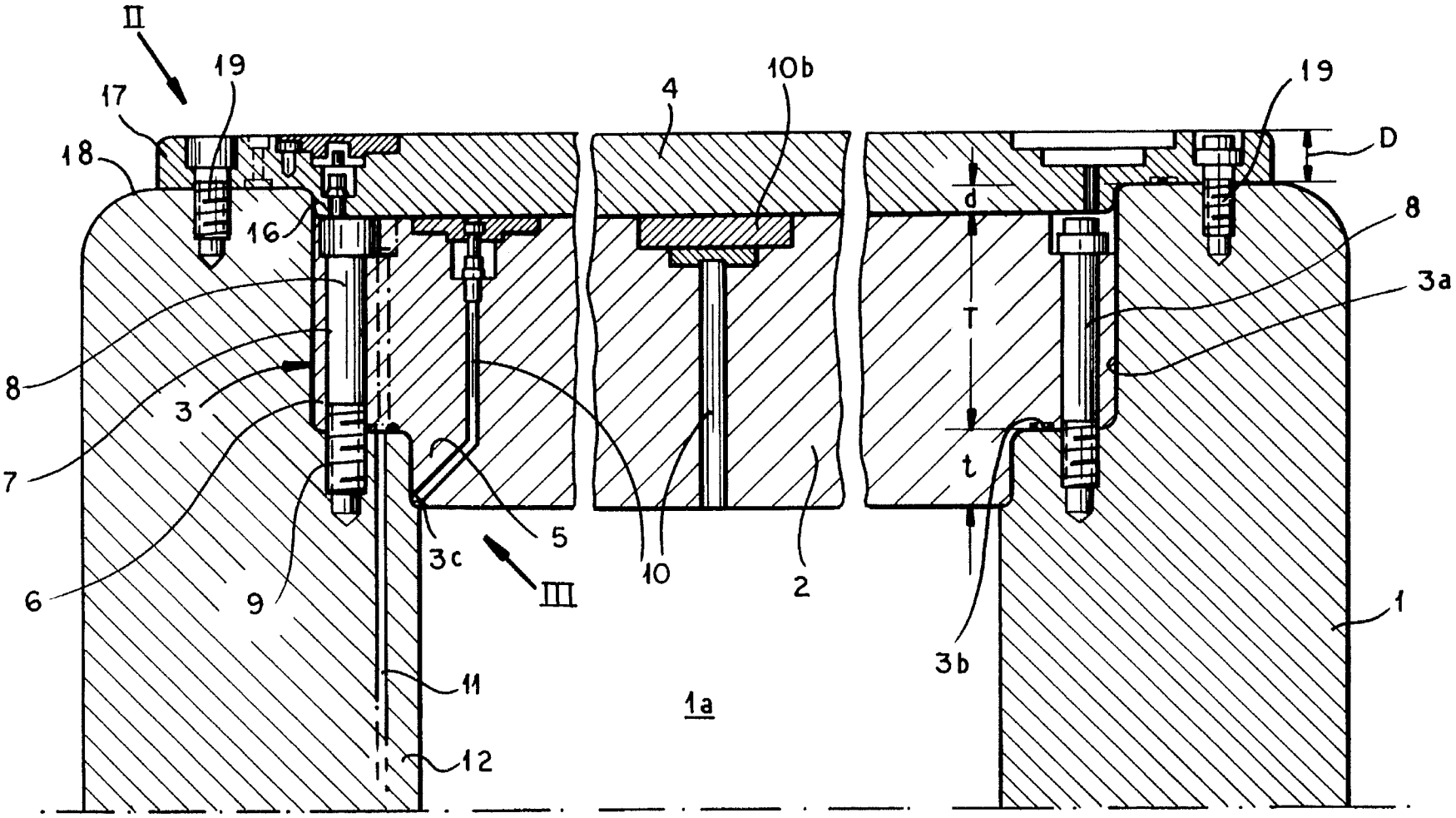
FIG. 1 is an axial cross section through the top of a carrier for the storage and transport of radioactive basins, e.g. nuclear fuel elements which apart from the differences described, can be constructed and used in the manner described in our copending application Ser. No. 243,627.
Figure 2:
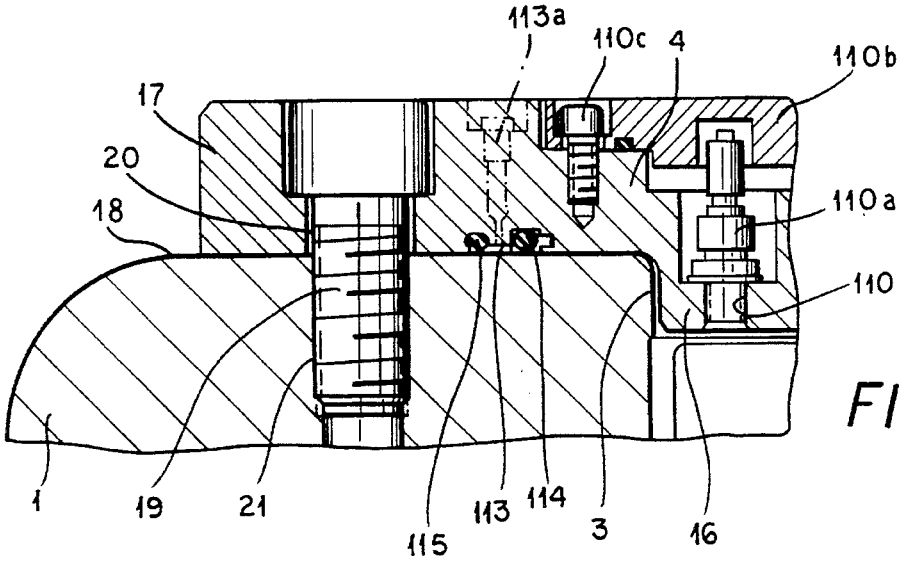
FIG. 2 is an enlarged cross sectional view of the region II of FIG. 1.
Figure 3:
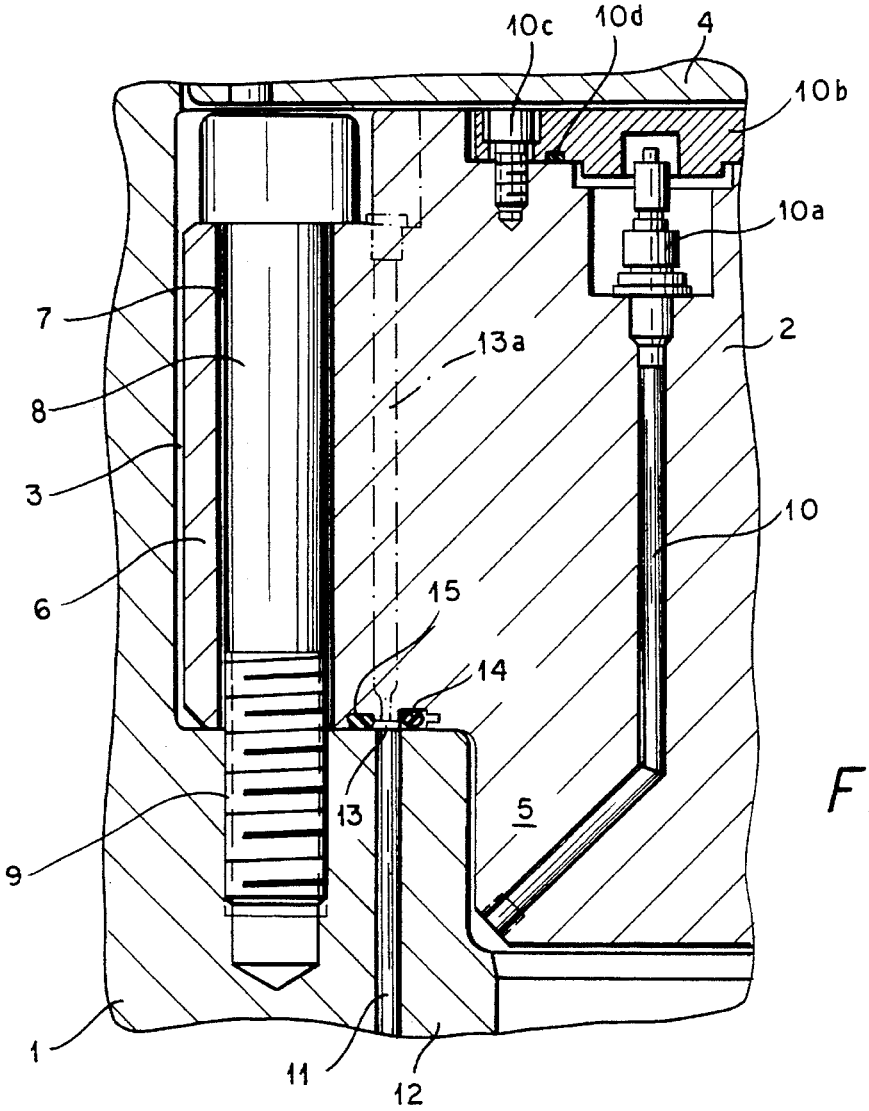
FIG. 3 is a detail of the region III of FIG. 1 drawn to a larger scale.

In FIGS. 1 through 3, we have shown a container which is utilized in principle in the same way as the container described in the parent application U.S. Pat. No. 4,528,454 and which comprises a spherulitic or nodular cast iron or cast steel vessel 1 provided with a compartment 1*a* receiving the irradiated fuel elements from a nuclear reactor.

The vessel 1 is closed by a shielding cover 2 which is received in a seat 3 formed as the mouth of the vessel 1 utilizing annular seals, if desired, as described in application U.S. Pat. No. 4,528,454 or the prior applications and patents mentioned therein.

The additional cover is represented at 4.

According to the present invention and as contrasted with the system of application U.S. Pat. No. 4,528,454, the shielding cover 2 is provided with an axial projection or plug formation 5 whose axial thickness t is less than the axial thickness T of a circumferential cylindrical flange 6 and which is unitary with the projection 5. Indeed, T is equal to two to four times t and is preferably about 3 t.

The flange 6 is cylindrical, as has been noted, and fits snugly in the cylindrical portion 3*a*, of the seat 3 and rests against the shoulder 3*b* thereof. The projection 5 can rest upon a shoulder 3*c* of this seat as well.

The flange 6 is provided with the usual bolt bores 7 which can be traversed by the bolts 8 which are screwed into internally threaded bores 9 of the wall of the vessel 1 registering with the bores 7 at the shoulder 3*b*.

In addition, the cover 2 can be provided with a number of bores 10 which open directly into the space 1*a* or into connecting bores 11 in the vessel wall communicating with the bottom of the space 1*a* for control or filling purposes or to enable monitoring of the contents.

These bores, as can be seen from FIG. 3, can be provided with valves or gauges 10*a* and are closed by plates 10*b* received in respective recesses in the cover 2 and sealed by bolts 10*c* and sealing rings 10*d*. Such bolts have been represented only diagrammatically in FIG. 1.

At least one annular control compartment 13 is provided in the immediate vicinity of the bolts 8 between seals 14 and 15 and can be monitored via the bore shown diagrammatically at 13*a* so that leakage of the junction between the flange 6 and the shoulder 3*b* can be detected.

The control compartment 13, of course is located between the array of bolts 8 and the compartment.

The additional cover 4, according to the invention, is not provided in a special recess as is the case with the outer cover of the container of application U.S. Pat. No. 4,528, 454, but rather has a plug-like projection 16 whose thickness d is less than the thickness D of the flange 17 which projects outwardly thereof. Preferably, the thickness D is about twice the thickness d.

In this container the flange 17 overlies the upper end 18 of the container wall 12 directly and is secured to the container wall by bolts 19 which pass through respective bores in the flange 17 and are threaded into bores of the container wall. The bores in the flange have been shown at 20 in FIG. 2 and the threaded bores of the container wall at 21. An additional annular control compartment 113 defined between seals 114 and 115 lies inwardly of the array of bolts 19 and can be monitored through a bore 113*a* which can be provided with a plug.

Control bores 110 in the cover 4 can also be provided with fittings 110*a* and can be closed by plates 110*b* held in place by bolts 110*c* analogous to the members 10*a* through 10*c* previously described.

We have shown in FIG, 1 with closely spaced hatching the practically rigid members which cooperate to close the transport and storage vessel and which function practically as a unitary structure capable of withstanding extreme stresses whether these are applied transverse to the covers or in the planes thereof. Of course the seals can be monitored by the usual devices previously described for this purpose.

We claim:

1. A radiation-shielding transport and storage container composed of spherulitic cast iron for irradiated fuel elements of a nuclear reactor which comprises:

an upright radiation-shielding vessel formed with a radiation-shielding wall surrounding the space adapted to receive radioactive material and provided with a mouth formed With a seat consisting of an inwardly extending annular shoulder and being cylindrical;

a radiation-shielding cover received in said seat and comprising a cylindrical flange resting on said shoulder and a plug-like projection extending from said flange into said space, said flange being unitary with said projection and having a thickness substantially two to four times the thickness of said projection, said flange being secured to said wall by a plurality of angularly spaced bolts traversing said flange and threaded into respective bores of said wall, said respective bores opening at said shoulder;

a further cover having a projection extending into said seat and a flange overlying an upper end of said wall and secured thereto by angularly equispaced bolts traversing the flange of said further cover and threaded into bores opening into the said end of said wall, the flange of said further cover being substantially twice the thickness of the projection thereof;

means defining a first annular control compartment between said shoulder and said flange of said shielding cover proximal to the bolts securing same to said shoulder but between the latter bolts and said space;

means forming a further annular compartment for monitoring sealing effectiveness of said covers and positioned between the flange of said further cover and said end of said wall proximal to the bolts securing the flange of said further cover to said end of said wall and between the latter bolts and said seat;

at least one control bore provided in said radiation-shielding cover communicating with said space, said bore provided with a monitoring device for monitoring radiation within said container and said bore being closed by a plate bolted to said radiation-shielding cover; and at least one further control bore for monitoring radiation within said container provided in said further cover opening into said seat and closed by a bolt plate, said at least one further control bore opening into said seat and being closed by a bolt plate.

* * * * *